US010607522B1

(12) United States Patent
Carneiro et al.

(10) Patent No.: US 10,607,522 B1
(45) Date of Patent: Mar. 31, 2020

(54) ADAPTIVE DRIVE SCHEME FOR ELECTROWETTING DISPLAYS

(71) Applicant: Amazon Technologies, Inc., Seattle, WA (US)

(72) Inventors: Steven Ramos Carneiro, Eindhoven (NL); Pavel Novoselov, Eindhoven (NL)

(73) Assignee: Amazon Technologies, Inc., Seattle, WA (US)

( * ) Notice: Subject to any disclaimer, the term of this patent is extended or adjusted under 35 U.S.C. 154(b) by 898 days.

(21) Appl. No.: 14/980,636

(22) Filed: Dec. 28, 2015

(51) Int. Cl.
*G09G 3/20* (2006.01)
*G09G 3/34* (2006.01)

(52) U.S. Cl.
CPC ..... *G09G 3/2003* (2013.01); *G09G 3/348* (2013.01); *G09G 2300/0452* (2013.01); *G09G 2300/0456* (2013.01); *G09G 2310/0278* (2013.01); *G09G 2310/061* (2013.01); *G09G 2310/08* (2013.01); *G09G 2320/0626* (2013.01); *G09G 2330/021* (2013.01)

(58) Field of Classification Search
CPC ..... G09G 3/348; G09G 3/2003; G09G 2300/0452; G09G 2300/0456; G09G 2310/0278; G09G 2310/061; G09G 2310/08; G09G 2320/0626; G09G 2330/021
See application file for complete search history.

(56) References Cited

U.S. PATENT DOCUMENTS

2001/0033277 A1* 10/2001 Sandoe ..... G09G 3/367 345/204
2005/0258780 A1* 11/2005 Chen ..... G09G 3/3406 315/291
2010/0231566 A1* 9/2010 Feenstra ..... G02B 26/005 345/211
2010/0277512 A1* 11/2010 Shen ..... G09G 3/2025 345/690
2012/0197955 A1* 8/2012 Brunelli ..... G06F 17/10 708/446
2014/0176408 A1* 6/2014 Park ..... G09G 3/3611 345/87

* cited by examiner

*Primary Examiner* — William Boddie
*Assistant Examiner* — Saifeldin E Elnafia
(74) *Attorney, Agent, or Firm* — EIP US LLP

(57) ABSTRACT

A display device includes a first substrate and a second substrate opposite to the first substrate. The display device includes a pixel region on the first substrate. The pixel region includes a plurality of input lines. Each input line is configured to apply an electric potential to a portion of a pixel in the pixel region. The display device includes a memory storing a drive scheme for the display device and a pixel control system. A solution to a cost function for the display device is calculated, such as by the pixel control system. The cost function expresses a performance attribute of the display device. The drive scheme is modified using the solution to the cost function to create a modified drive scheme, and a voltage is applied to one of the plurality of input lines according to the modified drive scheme to drive the display device.

19 Claims, 9 Drawing Sheets

ADAPTIVE DRIVE SCHEME FOR ELECTROWETTING DISPLAYS

BACKGROUND

Many portable electronic devices include displays for displaying various types of images. Examples of such displays include electrowetting displays (EWDs), liquid crystal displays (LCDs), electrophoretic displays (EPDs), light emitting diode displays (LED displays), etc. In EWD applications, an addressing scheme is utilized to drive the pixels of the EWD. Generally, one of the points of emphasis for EWD applications is low power design since in today's applications EWDs are often intended to be used in mobile and portable media devices.

An input video or data-stream generally represents a sequence of pixel display values, grouped per line; a sequence of lines, grouped per frame; and a sequence of frames defining a frame sequence. When such a data stream is to be reproduced on an active matrix EWD, a timing controller and display drivers are used to process the incoming data-stream and to control the state of the actual pixels of the EWD. A specific addressing scheme is used by the timing controller to timely control source and gate drivers of the EWD. The purpose of an addressing scheme is to set (or maintain) the state of a pixel. The addressing scheme drives an active matrix transistor array and provides analog voltages to individual pixels of the EWD. These voltages modulate the luminance of the pixels of the EWD. The pixels are grouped per row and when a row is addressed, voltages of a complete row are stored as charge on corresponding pixel capacitors. As the display-data is repeatedly updated, still and moving images can be reproduced by the EWD.

When driving the pixels of a display, various components operate according to a drive scheme. In conventional devices these drive schemes are usually created in an ad hoc manner, oftentimes in a lab setting, and are fixed for a particular device. Because the drive scheme is fixed, the same drive scheme would be used for a display device that is displaying text data, which changes infrequently, and a display device that is depicting video content, which changes frequently and requires a high refresh rate. Because of this, a drive scheme that may be efficient for a first display device operating mode (e.g., displaying text) would continue to be used in other modes (e.g., displaying video or game content), even when the drive scheme is not as efficient.

BRIEF DESCRIPTION OF THE DRAWINGS

The detailed description is described with reference to non-limiting and non-exhaustive embodiments illustrated in the accompanying figures. The same reference numerals in different figures refer to similar or identical items.

DETAILED DESCRIPTION

Figure 1A:
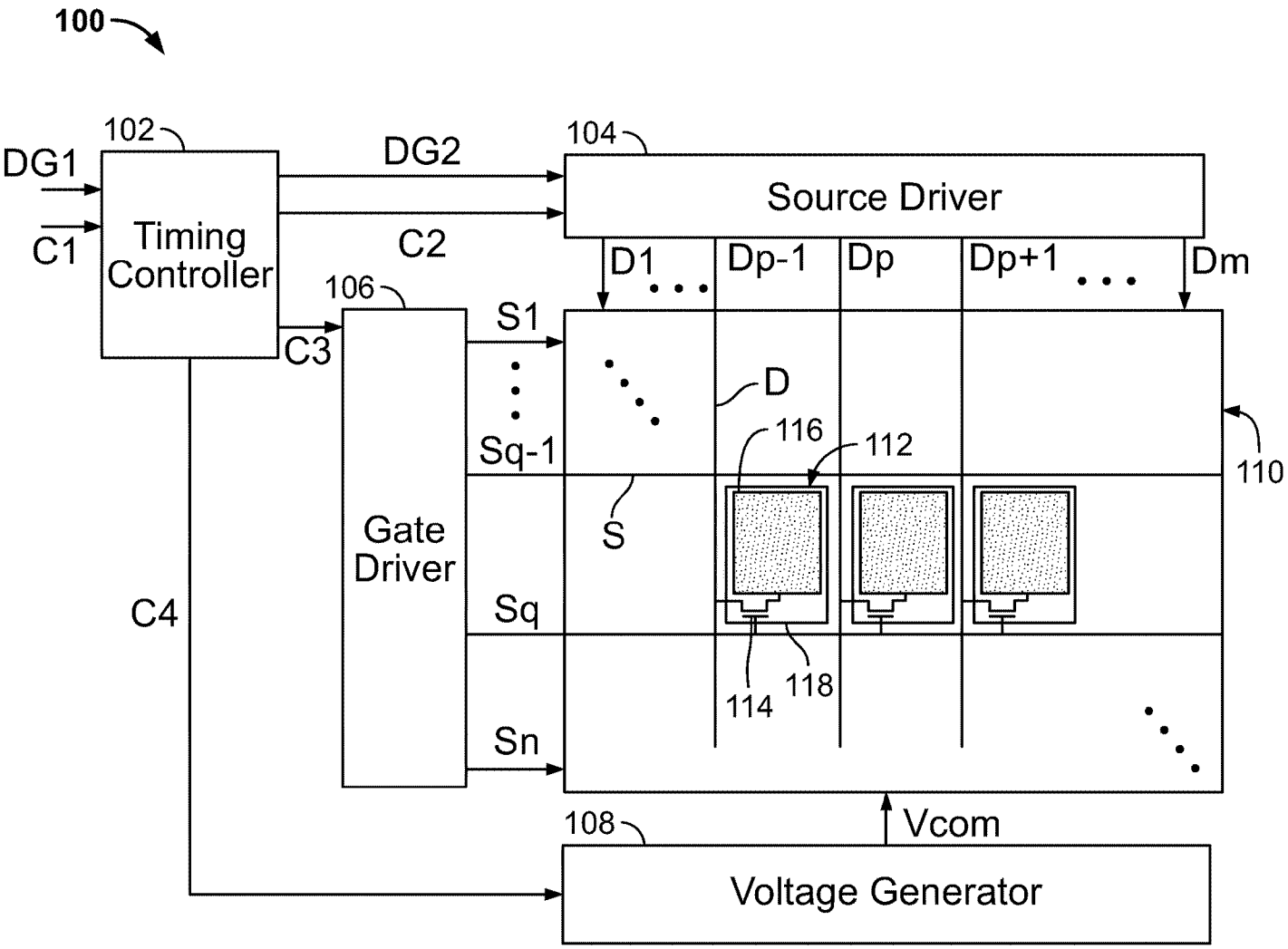
FIG. 1A is a block diagram depicting components of an example electrowetting display device, according to various embodiments.

In various embodiments described herein, electronic display devices include electrowetting displays for presenting content and other information. In some examples, the electronic devices may include one or more components associated with the display device, such as a touch sensor component layered atop the electrowetting display for detecting touch inputs, and a front light or back light component for lighting the electrowetting display.

An electrowetting pixel includes a number of pixel walls. The pixel walls form a structure that is configured to contain at least a portion of a first liquid, such as an opaque oil. Light transmission through the pixel can be controlled by application of an electric potential or driving voltage (i.e., a voltage) to the pixel, which results in a movement of a second liquid, such as an electrolyte solution, into the pixel, thereby displacing the first liquid.

For a reflective EWD, when the electrowetting pixel is in a resting state (i.e., the closed or off-state, with no electric potential applied), the opaque oil is generally distributed throughout the pixel. The oil absorbs light and the pixel in this condition appears dark. But when the pixel is in the active state (i.e. the at least partially open state—the on-state—with an electric potential applied), the electrolyte solution moves within the pixel displacing the oil so that the oil is no longer distributed throughout the pixel. Light can then enter the pixel and strike a reflective surface that would otherwise be obscured by the opaque oil. The light then reflects out of the pixel, causing the pixel to appear less dark, e.g. white, to an observer. If the reflective surface only reflects a portion of the light spectrum or if color filters are incorporated above the pixel, the pixel may appear to be grey or have color.

Within a display device, a timing controller analyzes an incoming data stream that may describe the images (e.g., graphics and text) to be displayed on the display device. Based upon that analysis, the timing controller controls the state of the display device's pixels in order to depict the images appropriately. To control the state of a particular pixel, the timing controller interacts with and controls a source driver and a gate driver using an addressing scheme. Generally, the timing controller will supply both the source and gate drivers with data signals indicating that the states of particular pixels within the display device be set in a particular manner. The source and gate drivers will then convert those data signals into a number of different voltages supplied to the particular pixels using various input lines. The voltages are configured to set the particular pixels into the states as specified by the timing controller.

The operations of the timing controller, source driver, gate driver, and other components of the display device are generally managed according to a drive scheme. The drive scheme may establish the frequency at which the timing controller should operate, as well as the manner in which the timing controller processes incoming display data. The driving scheme may also determine the various voltages used by the source and gate drivers to control the state of the display device's pixels.

Depending upon the display device's current operational mode, the drive scheme may be optimized to provide improved performance. The display device's operational mode describes the current condition and manner of operation of the display device. The mode of operation could involve, for example, the sporadic display of video data interspersed with text or the processing of large amount of data involved in three-dimensional gaming or rendering of three-dimensional images. In that case, a drive scheme optimized for the display of either text or video data may not be particularly efficient or effective. The mode of operation could also involve the display device's components operating at particular voltages or frequencies, or at, for example, particular operating temperatures. The mode of operation could also involve the display device accessing a wireless network communications network using particular network protocols or at particular data rates. In some cases, the mode of operation of the display device may be at least partially determined by ambient conditions of the display device. For example, if the display device is in relatively low ambient light conditions, that may cause the display device to operate in a mode with a particular level of back light (or other illumination device) illumination. Conversely, if the display device is operating in high ambient light conditions, the display device may operate in a different mode calling for a different level of back light illumination. In the present system, therefore, the timing controller is configured to monitor the current operational mode of the display device and update, in real time, the driving scheme to be more suited to that mode.

In one embodiment, a number of different cost functions are defined within the timing controller. Each cost function describes or represents some attribute of the display device and may take as arguments or inputs to the cost function current operational characteristics of the display device as well as variables for particular values in the drive scheme. An optimized solution to the cost function can then be calculated by determining optimum values for the cost function's variables. This may involve, for example, selecting an initial set of value for the variables of the cost function and then iteratively varying those values in order to identify an optimized, or at least partially optimized, solution. Example methods for optimizing cost functions may include heuristic algorithms, such as particle swarm optimization (PSO), genetic algorithms, and evolutionary algorithms. Other approaches may utilize other optimization algorithms, iterative approaches, or convergence techniques. Once determined, those optimum variable values can be used to update the device's drive scheme to be more effective for the current operational mode.

In some cases, the optimized solution to a particular cost function will not, in fact, be the optimal solution and will instead be another valid solution to the cost function. For example, where iterative approaches are used to solve or optimize a cost function, the iterative approach may end before a perfectly optimized solution to the cost function can be identified. In that case, the solution, though valid, may be less than fully optimized. In some cases, the solution may represent best guesses or approximations of an optimal solution, but may still represent valid solutions to the cost function. In the present disclosure, although the term optimized solution may be used, it is to be understood that an optimized solution may not be the single optimal solution to a cost function and may instead refer to any valid solution to a cost function that is identified by any suitable approach for identifying solutions to cost functions. As such, in the present disclosure, the term optimized solution or optimal variable value may refer to an improved or adjusted solution or variable value with respect to a particular cost function.

For example, one cost function may represent the power used by the display device, while a second cost function may represent the display device's display quality. With the cost functions defined, the timing controller executes an optimization algorithm, described in more detail below, to determine an optimum solution to the cost functions. Because the cost functions take arguments that describe the display device's current operational mode as well as variables associated with particular values in the drive scheme, the optimum solution to the cost functions can be used to update the drive scheme with those optimum values. The optimized drive scheme can then be employed by the device's components, such as the timing controller and source and gate drivers, to control the display device.

The timing controller may constantly re-execute the cost function optimization algorithm so that the values of the drive scheme are constantly updated and optimized based upon the current operational mode of the display device.

The present disclosure provides a number of examples of the present display device 100 in which the display device 100 is described as a reflective display device. It will be understood, however, that the devices and methods described herein are equally applicable to transmissive and transflective devices. A pixel may, unless otherwise specified, comprise a single sub-pixel or a pixel that includes two or more sub-pixels of an electrowetting display device. Such a pixel or sub-pixel may be the smallest light transmissive, reflective or transflective element of a display that is individually operable to directly control an amount of light transmission through and/or reflection from the element. For example, in some implementations, a pixel may be a pixel that includes a red sub-pixel, a green sub-pixel, a blue sub-pixel and a white sub-pixel. In other implementations, a pixel may be a pixel that is a smallest component, e.g., the pixel does not include any sub-pixels or is, in fact, a sub-pixel itself.

In general, image display apparatuses, such as, for example, various electronic devices, including, but not limited to, portable computing devices, tablet computers, laptop computers, notebook computers, mobile phones, personal digital assistants (PDAs), and portable media devices (e.g., e-book devices, DVD players, etc.), display images on a display. Examples of such displays include, but are not limited to, LCDs, EWDs and EPDs.

More particularly, a display device, such as an electrowetting display device, for example, can be a thin film transistor electrowetting display (TFT-EWD) that generally includes an array of transmissive, reflective or transflective pixels or sub-pixels (referred to herein as pixels) configured to be operated by an active matrix addressing scheme. For example, rows and columns of pixels are operated by controlling voltage levels on a plurality of source lines and gate lines. In this fashion, the display device can produce an image by selecting particular pixels to transmit, reflect or block light. Pixels are addressed (e.g., selected) via source lines and gate lines that are connected to transistors (e.g., TFTs, used as switches) in communication with each pixel. Transistors take up a relatively small fraction of the area of each pixel. For example, the transistor can be located underneath the reflector in reflective displays.

Electrically, the pixel is a small capacitor with a layer of insulating optical material (e.g., liquid crystal material or electrowetting material) sandwiched between two substrates, wherein each substrate generally includes a transparent conductive indium tin oxide (ITO) layer. A switching current-passing characteristic of the transistor of the pixel prevents charge that is being applied to the pixel from draining between refresh cycles of the display's image.

An electrowetting display device employs an applied voltage to change the surface tension of a liquid in relation to a surface. For instance, by applying a voltage to a hydrophobic surface via a pixel electrode in conjunction with a common electrode, the wetting properties of the surface can be modified so that the surface becomes increasingly hydrophilic. Hydrophobic generally refers to repelling water or polar fluids while hydrophilic generally refers to having an affinity for water or polar fluids.

As one example of an electrowetting display, the modification of the surface tension by applying a voltage causes a fluid that includes an electrolyte, i.e. the polar fluid, in an electrowetting liquid in individual pixels of the display to adhere to the modified surface and thus, replace an electrowetting oil layer in individual pixels of the display. Thus, the electrowetting fluids in the individual pixels of the display responding to the change in surface tension act as an optical switch. When the voltage is absent, the electrowetting oil forms a continuous film within a pixel, and the color may thus be visible to a user of the display. On the other hand, when the voltage is applied to the pixel, the electrowetting oil is displaced and the pixel becomes reflective. When multiple pixels of the display are independently activated, the display can present a color or grayscale image. The pixels may form the basis for a transmissive, reflective, or transmissive/reflective (transreflective) display. Further, the pixels may be responsive to high switching speeds (e.g., on the order of several milliseconds), while employing small pixel dimensions. Accordingly, the electrowetting displays herein may be suitable for applications such as displaying video content. In addition, the low power consumption of electrowetting displays in general makes the technology suitable for displaying content on portable display devices that rely on battery power.

For the driving of electrowetting displays, a dedicated gate scanning algorithm is generally implemented. In general, a first write action discharges a pixel to a reset level, e.g., a black level voltage, which is also referred to as a reset of the pixel. A second write action generally charges the pixel to an actual required display data value.

The power consumption of an electrowetting display depends on the electrowetting display's physical properties, as well as image content. The power consumption of an electrowetting display can be modeled as an array of capacitors (corresponding to each of the display's pixels), which are continuously charged and discharged with new image data. The most relevant parameters are capacitive load (of the pixels and the electrowetting display), drive voltage for the pixels, and the addressing rate for the pixels. These parameters determine the rate and charge required to readdress the electrowetting display.

Referring to FIG. 1A, an example of an electrowetting display device 100 is schematically illustrated that includes a timing controller 102, a source driver (data driver) 104, a gate driver (scan driver) 106, a voltage generator 108, and an electrowetting display panel 110. The electrowetting display panel 110 is driven by the timing controller 102, the source driver 104, the gate driver 106 and the voltage generator 108. In the present disclosure, timing controller 102, source driver 104, gate driver 106, and voltage generator 108 may collectively be referred to as a pixel control system.

As an example of general operation of the electrowetting display device 100, responsive to a first data signal DG1 and a first control signal C1 from an external image source, e.g., a graphic controller (not illustrated), the timing controller 102 applies a second data signal DG2 and a second control signal C2 to the source driver 104; a third control signal C3 to the gate driver 106; and a fourth control signal C4 to the voltage generator 108.

The source driver 104 converts the second data signal DG2 to voltages, i.e., data signal voltage values, and applies the data signals D1, . . . , Dp−1, Dp, Dp+1, . . . , Dm to the electrowetting display panel 110. At an address rate or scan rate, the gate driver 106 sequentially applies scan signals S1, . . . , Sq−1, Sq, . . . , Sn to the electrowetting display panel 110 in response to the third control signal C3.

The voltage generator 108 applies a common voltage Vcom to the electrowetting display panel 110 in response to the fourth control signal C4. Although not illustrated in FIG. 1A, the voltage generator 108 generates various voltages required by the timing controller 102, the source driver 104, and the gate driver 106.

Pixel regions 112 are positioned adjacent to crossing points of the data lines D and the gate lines S and thus are arranged in a grid of rows and columns. Each pixel region 112 includes a hydrophobic surface (not illustrated in FIG. 1A), and a thin film transistor (TFT) 114 and a pixel electrode 116 under the hydrophobic surface. Each pixel region 112 may also include a storage capacitor (not illustrated) under the hydrophobic surface. A plurality of intersecting partition or pixel walls 118 separates the pixel regions 112. Pixel regions 112 can include pixels within the electrowetting display 100 or sub-pixels within the electrowetting display 100, depending upon the application for the electrowetting display 100.

The electrowetting display panel 110 includes m data lines D, i.e., source lines, to transmit the data voltages and n gate lines S, i.e., scan lines, to transmit a gate-on signal to the TFTs 114 to control the pixel regions 112. Thus, the timing controller 102 controls the source driver 104 and the gate driver 106. The timing controller 102 applies a second data signal DG2 and a second control signal C2 to the source driver 104; a third control signal C3 to the gate driver 106; and a fourth control signal C4 to the voltage generator 108 to drive the pixel regions 112. The gate driver 106 sequentially applies scan signals S1, . . . , Sq−1, Sq, . . . , Sn to the electrowetting display panel 110 in response to the third control signal C3 to activate rows of pixel regions 112 via the gates of the TFTs 114. The source driver 104 converts the second data signal DG2 to voltages, i.e., data signals, and applies the data signals D1, . . . , Dp−1, Dp, Dp+1, . . . , Dm to sources of the TFTs 114 of the pixel regions 112 within an activated row of pixel regions 112 to thereby activate (or leave inactive) pixel regions 112.

The timing controller 102 selectively operates at a frequency which, in turn, determines how quickly each row of pixel regions 112 within display panel 110 are addressed. If the operational frequency of the timing controller 102 is increased, the rows of pixel regions 112 will be addressed more quickly, thereby increasing the refresh rate of display device 100. This, however, will result in an increase in power consumed by the timing controller 102 and the other components of the display device 100.

Figure 1B:
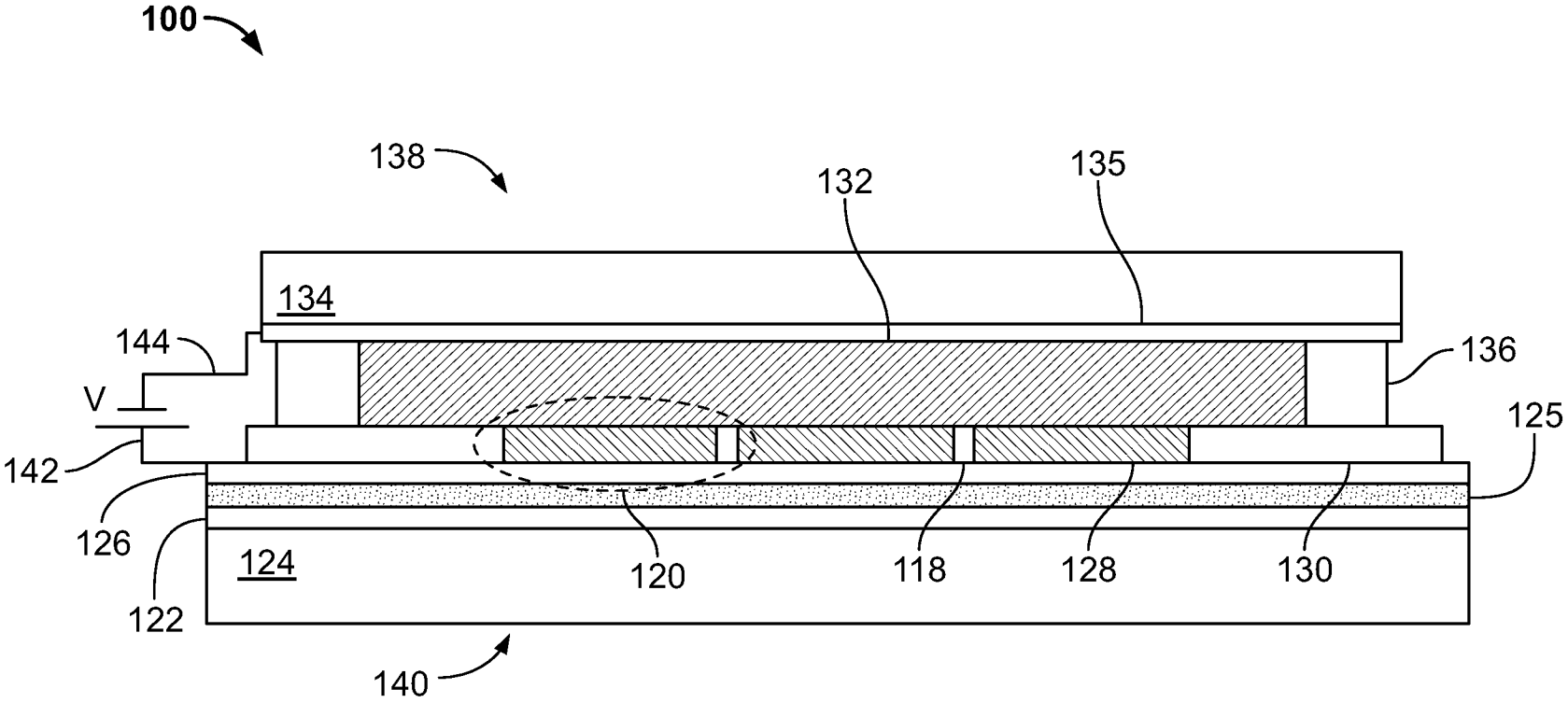
FIG. 1B is a cross-section of a portion of an electrowetting display device, according to some embodiments.

FIG. 1B is a cross-section of a portion of the electrowetting display device 100 showing details of several electrowetting pixels 120 that may each reside within one of pixel regions 112 of FIG. 1A, according to some embodiments.

An electrode layer 122 that includes the pixel electrodes 116 (not illustrated in FIG. 1B) is formed on a bottom support plate 124. Thus, the electrode layer 122 is generally divided into portions that serve as the pixel electrodes 116 (not illustrated in FIG. 1B).

In some implementations, a dielectric barrier layer 125 may at least partially separate the electrode layer 122 from a hydrophobic layer 126 also formed on the bottom support plate 124 over the electrode layer 122. While optional, the dielectric barrier layer 125 may act as a barrier that prevents electrolyte components (e.g., an electrolyte solution) from reaching the electrode layer 122. The dielectric barrier layer 125 may comprise an inorganic layer, such as a silicon dioxide layer (e.g., about 0.2 microns thick), and an organic layer, such as polyimide layer (e.g., about 0.1 micron thick), though claimed subject matter is not so limited. In some implementations, the hydrophobic layer 126 can comprise a fluoropolymer, such as, for example, AF1600, produced by DuPont, based in Wilmington, Del.

The pixel walls 118 form a patterned electrowetting pixel grid on the hydrophobic layer 126, as can be seen in FIG. 1A. The pixel walls 118 may comprise a photoresist material, such as, for example, epoxy-based negative photoresist SU-8. The patterned electrowetting pixel grid comprises rows and columns that form an electrowetting pixel array (e.g., electrowetting display panel 110). For example, an electrowetting pixel can have a width and length in a range of about 50 to 500 microns. A first fluid 128, which can have a thickness or depth in a range of about 1 to 10 microns, for example, overlies the hydrophobic layer 126. The first fluid 128 is generally an oil, often referred to as an electrowetting oil, and is partitioned by the pixel walls 118 of the patterned electrowetting pixel grid. An outer rim 130 can comprise the same material as the pixel walls 118. A second fluid 132, such as a fluid that includes an electrolyte, overlies the oil 128 and the pixel walls 118 of the patterned electrowetting pixel grid.

The second fluid 132 is substantially immiscible with the first fluid 128. Generally, immiscible refers to the inability of the second fluid 132 to mix or blend with the first fluid 128. The second fluid 132 generally includes an electrolyte and is electrically conductive or polar. The second fluid 132 may be water or a salt solution such as a solution of potassium chloride in a mixture of water and ethyl alcohol, for example. The second fluid 132 may be transparent, colored, or color-absorbing. The first fluid 128, generally referred to as oil, is electrically non-conductive and may for instance be an alkane like hexadecane or (silicone) oil. The hydrophobic layer 126 is arranged on the bottom support plate 124 to create an electrowetting surface area. The hydrophobic character causes the first fluid 128 to adhere preferentially to the bottom support plate 124 since the first fluid 128 has a higher wettability with respect to the surface of the hydrophobic layer 126 than the second fluid 132. Wettability relates to the relative affinity of a fluid for the surface of a solid. Wettability increases with increasing affinity, and it can be measured by the contact angle formed between the fluid and the solid and measured internal to the fluid of interest. For example, such a contact angle can increase from relative non-wettability of more than 90° to complete wettability at 0°, in which case the fluid tends to form a film on the surface of the solid.

A color filter 137 may be positioned over each pixel 120. The color filters 137 may be transmissive to certain portions of the visible light spectrum (e.g., red), while inhibiting transmission of other portions of the visible light spectrum (e.g., non-red colors of light). In this manner, color filters 137 may be used to associate each pixel 120 with a particular color. In one embodiment, pixels 120 may correspond to sub-pixels of display device 100. In that case, each sub-pixel 120 may include the appropriate color filters 137 so that four different sub-pixels 120 correspond to a red sub-pixel, a green sub-pixel, a blue sub-pixel and a white sub-pixel of a larger pixel.

A top support plate 134 is positioned opposite the bottom support plate 124. The top support plate 134 covers the second fluid 132 and edge seals 136 retain the second fluid 132 over the electrowetting pixel array. The bottom support plate 124 and the top support plate 134 may be separate parts of individual electrowetting pixels or the bottom support plate 124 and the top support plate 134 may be shared by a plurality of electrowetting pixels. The bottom support plate 124 and the top support plate 134 may be made of glass or polymer and may be rigid or flexible, for example.

A voltage V applied across the second fluid 132 and the electrode layer 122 of individual electrowetting pixels can control transmittance or reflectance of the individual electrowetting pixels. More particularly, in a number of embodiments, the electrowetting display 100 may be a transmissive, reflective or transflective display that generally includes an array of pixels or pixels in pixel regions (e.g., the pixel regions 112 of FIG. 1A) configured to be operated by an active matrix addressing scheme. For example, rows and columns of electrowetting pixels are operated by controlling voltage levels on a plurality of source lines (e.g., source lines D of FIG. 1A) and gate lines (e.g., gate lines S of FIG. 1A). In this fashion, the electrowetting display 100 may produce an image by selecting particular pixels to at least partly transmit, reflect or block light.

The electrowetting display device 100 has a viewing side 138 on which an image for display formed by the electrowetting display device 100 can be viewed, and a rear side 140. The top support plate 134 faces viewing side 138 and the bottom support plate 124 faces the rear side 140. The top support plate 134 is coupled to the bottom support plate 124 with an adhesive or sealing material 136. In an alternative embodiment, the electrowetting display device 100 may be viewed from the rear side 140. The electrowetting display device 100 may be a reflective, transmissive or transreflective type. The electrowetting display device 100 may be a segmented display type in which the image is built up of segments. The segments can be switched simultaneously or separately. Each segment includes one electrowetting pixel 120 or a number of electrowetting pixels 120 that may be neighboring or distant from one another. The electrowetting pixels 120 included in one segment are switched simultaneously, for example. The electrowetting display device 100 may also be an active matrix driven display type or a passive matrix driven display, just to name a few examples.

The electrode layer 122 is separated from the first fluid 128 and the second fluid 132 by an insulator, which may be the hydrophobic layer 126. The electrode layer 122 (and thereby the pixel electrodes 116) is supplied with voltage signals V by a first signal line 142 as will be further described herein. A second signal line 144 is electrically connected to a top electrode 135 that is in contact with the conductive second fluid 132. This top electrode may be common to more than one electrowetting pixel 120 since the electrowetting pixels 120 are fluidly interconnected by and share the second fluid 132 uninterrupted by the pixel walls 118. The electrowetting pixels 120 are controlled by the voltage V applied between the first and second signal lines 142 and 144.

In some embodiments, the first fluid 128 absorbs at least a part of the optical spectrum. The first fluid 128 may be transmissive for a part of the optical spectrum, forming a color filter. For this purpose, the first fluid 128 may be colored by addition of pigment particles or dye, for example. Alternatively, the first fluid 128 may be black (e.g., absorbing substantially all parts of the optical spectrum) or reflecting. The hydrophobic layer 126 may be transparent or reflective. A reflective layer may reflect the entire visible spectrum, making the layer appear white, or part of it, making it have a color.

When the voltage V applied between the signal lines 142 and 144 is set at a non-zero active signal level, the electrowetting pixel 120 will enter into an active state. Electrostatic forces will move the second fluid 132 toward the electrode layer 122, thereby displacing the first fluid 128 from the area of the hydrophobic layer 126 towards a portion of one or more pixel wall 118 surrounding the area of the hydrophobic layer 126, to a droplet-like shape. This action uncovers the first fluid 128 from the surface of the hydrophobic layer 126 of the electrowetting pixel 120. When the voltage across the electrowetting pixel 120 is returned to an inactive signal level, the electrowetting pixel 120 will return to an inactive state, where the first fluid 128 flows back to cover the hydrophobic layer 126. In this way, the first fluid 128 forms an electrically controllable optical switch in each electrowetting pixel 120.

Generally, the thin film transistor 114 includes a gate electrode that is electrically connected to a corresponding scan line of the scan lines S, a source electrode that is electrically connected to a corresponding data line of the data lines D, and a drain electrode that is electrically connected to the pixel electrode 116. Thus, the pixel regions 112 are operated, i.e. driving of the electrowetting display 100, based upon the scan lines S and the data lines D of FIG. 1A.

For driving of electrowetting displays via the scan lines S and the data lines D, a dedicated gate scanning algorithm may generally be implemented. The gate scanning algorithm generally defines an address timing for addressing rows of pixel regions 112. Within each input frame, each row (corresponding to the scan lines S) of electrowetting pixels 120 within the electrowetting display 100 generally needs to be written twice. On occasion, the amount of writing can be more, depending on the actual drive scheme implementation. In general, the first write action discharges an electrowetting pixel 120 to a reset level, e.g., a black level voltage, which is also referred to as a reset of the pixel. The second write action generally charges the electrowetting pixel 120 to an actual required display data value. Often, pixel regions 112 may need to be refreshed to maintain their appearance when the corresponding data value for a particular pixel region 112 does not change. This is especially true when the electrowetting display 100 is displaying a still image when all of the pixel regions 112 may need to be refreshed. A refresh sequence generally involves a reset sequence followed by a repeat sequence, which recharges pixel regions 112 with their display data values.

Figure 1C:
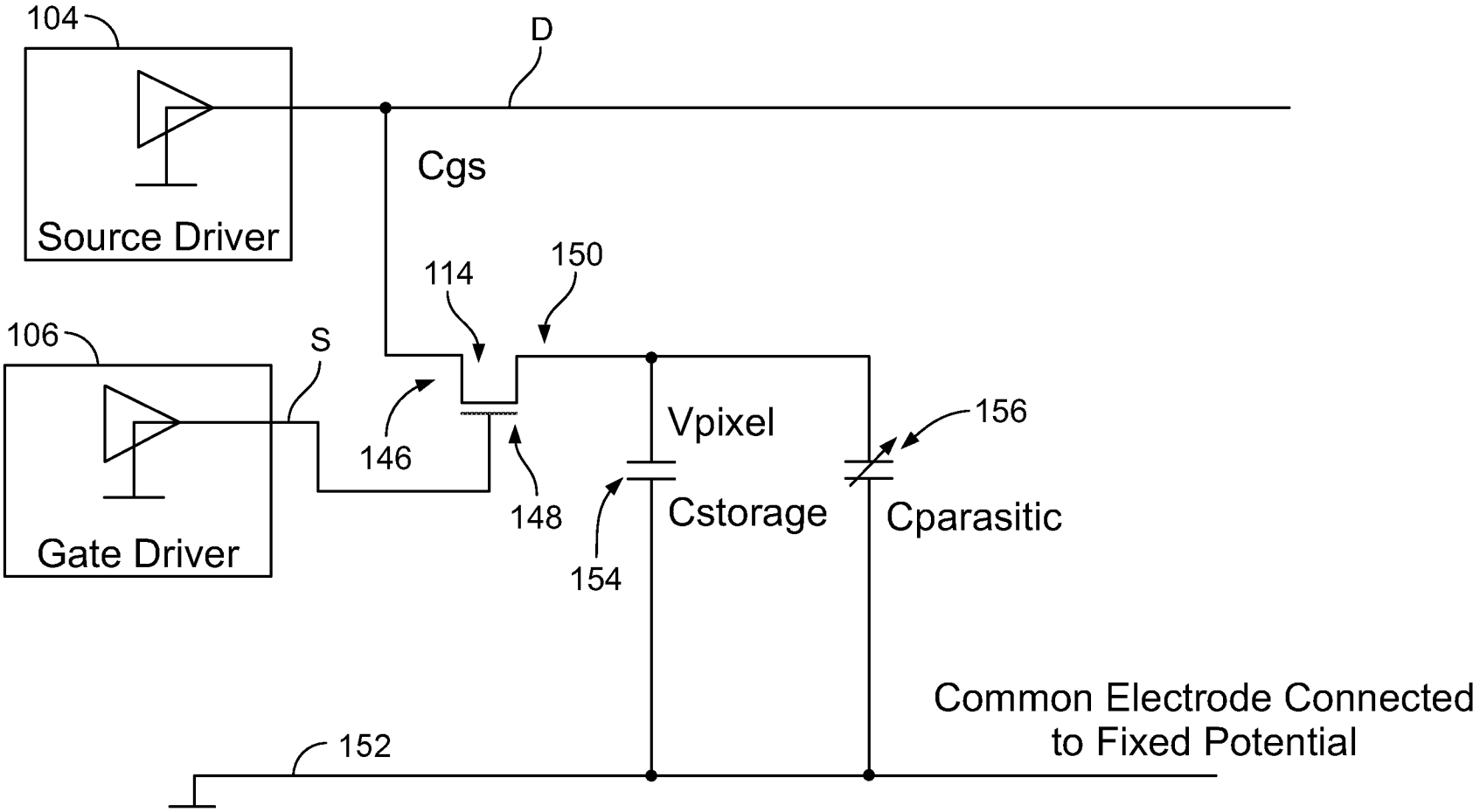
FIG. 1C is a schematic view representing circuitry for pixels within the electrowetting display of FIGS. 1A and 1B, according to some embodiments.

FIG. 1C schematically illustrates an arrangement of thin film transistor (TFT) 114 for a pixel region 112 within the electrowetting display 100. Each pixel region 112 within the electrowetting display 100 generally includes such an arrangement. The source driver 104 is coupled to a data line D. The data line D is coupled to a source 146 of the TFT 114 for the pixel region 112. A scan line S is coupled to a gate 148 of the TFT 114. The scan line S is coupled to a gate driver 106. A drain 150 of the TFT 114 is coupled to a common line 152 that is coupled to a fixed potential of a common electrode (not illustrated) within the electrowetting display 100. The common line 152 may also be coupled to ground. A storage capacitor 154 is provided between the TFT 114 and the common line 152. A variable parasitic capacitance, Cparasitic, is present in each pixel region 112 between the drain 150 of the TFT 114 and the common line 152. The variable parasitic capacitance is represented by a variable capacitor 156.

Display device 100 is operated according to a drive scheme. The drive scheme is a collection of configuration settings (e.g., stored within a data file in a memory or storage system) that specifies certain values that are then used by the various components of electrowetting display 100 during operation. The settings can then be retrieved by various components of electrowetting display 100 and utilized by the components to control how the components operate. Alternatively, a processor or controller may retrieve values from the drive scheme and configure one or more other components of electrowetting display 100 (or, in fact, the processor or controller itself) in accordance with the values from the drive scheme. Various drive schemes may store absolute values for particular configuration settings or, alternatively, ranges of values. For example, the drive scheme may specify the frequency at which timing controller 102 should operate as well as the frequency at which the pixels of electrowetting display 100 should be refreshed. The drive scheme may also specify the gate and source voltages (both high and low), frame rate, line time, clock frequency, reset voltage values, a number of sub-frames, common voltage, gain, gain factor, and the like. For example, the drive scheme may specify specific voltages values for both data signals D1, . . . Dp−1, Dp, Dp+1, . . . , Dm and scan or gate signals S1, . . . , Sq−1, Sq, . . . , Sn or define how inputs from the device's timing controller are to be converted into data signals and gate signals having specific voltages. The drive scheme may also specify a particular common voltage Vcom to be supplied to the display panel 110. With regards to the pixel write action described above, the drive scheme could also specify a particular voltage to be used when resetting a pixel. Similarly, the drive scheme may also specify a period of time or reset duration over which the reset voltage should be supplied to a particular pixel in order to sufficiently reset the pixel. The reset duration could be expressed in a number of seconds or, alternatively, as a number of addressing periods over which the pixel being reset should be subjected to the reset voltage. The drive scheme may also specify that a particular gate scanning algorithm is to be used by timing controller when addressing the various pixels of electrowetting display 100.

In general, a drive scheme may be optimized for a particular operating mode of electrowetting display 100. If, for example, electrowetting display 100 is being used to display text data, such a mode may not call for electrowetting display 100 to render information quickly or at a particularly high frame rate. In that case, an optimized drive scheme may call for the operating frequency of the timing controller 102 to be reduced and the data signal and gate signal voltage values to be reduced to reduce power consumption of electrowetting display 100 while still providing sufficient display quality for a user to read the text information.

Although such a drive scheme may be well suited to the display of text data, the drive scheme may not be appropriate for the display of video data. In that case, a higher frame rate may be required and, as such, an appropriate drive scheme would call for increasing the operating frequency of the timing controller 102 and potentially raising the data signal and gate signal voltage values to increase the rate at which the states of the display device's pixel can be set. These changes could allow the state of the pixels of electrowetting display 100 to change state quicker allowing for higher quality video rendering, but may result in increased power consumption and, thereby, shorter battery life and operating time.

In a conventional display device, the drive scheme is often developed ad hoc and is fixed. As a result, the drive scheme that is ultimately utilized within conventional display devices is often not optimized for any particular operating mode and is instead selected to provide adequate performance in all manner of operating modes. As a consequence, the drive scheme is often ineffective or inefficient for a given mode, but conventional devices do not provide a mechanism for optimizing the drive scheme based upon the device's current operating mode.

In the present display device the timing controller (or another suitably-configured processor within the device) is configured to monitor the display device's current operational mode. Based upon that mode, the timing controller can determine an optimized drive scheme that is suited to the current mode. Once determined, various components within the display device can be configured in accordance with the drive scheme, and the display device settings specified therein, to modify or control their operation.

Figure 2:
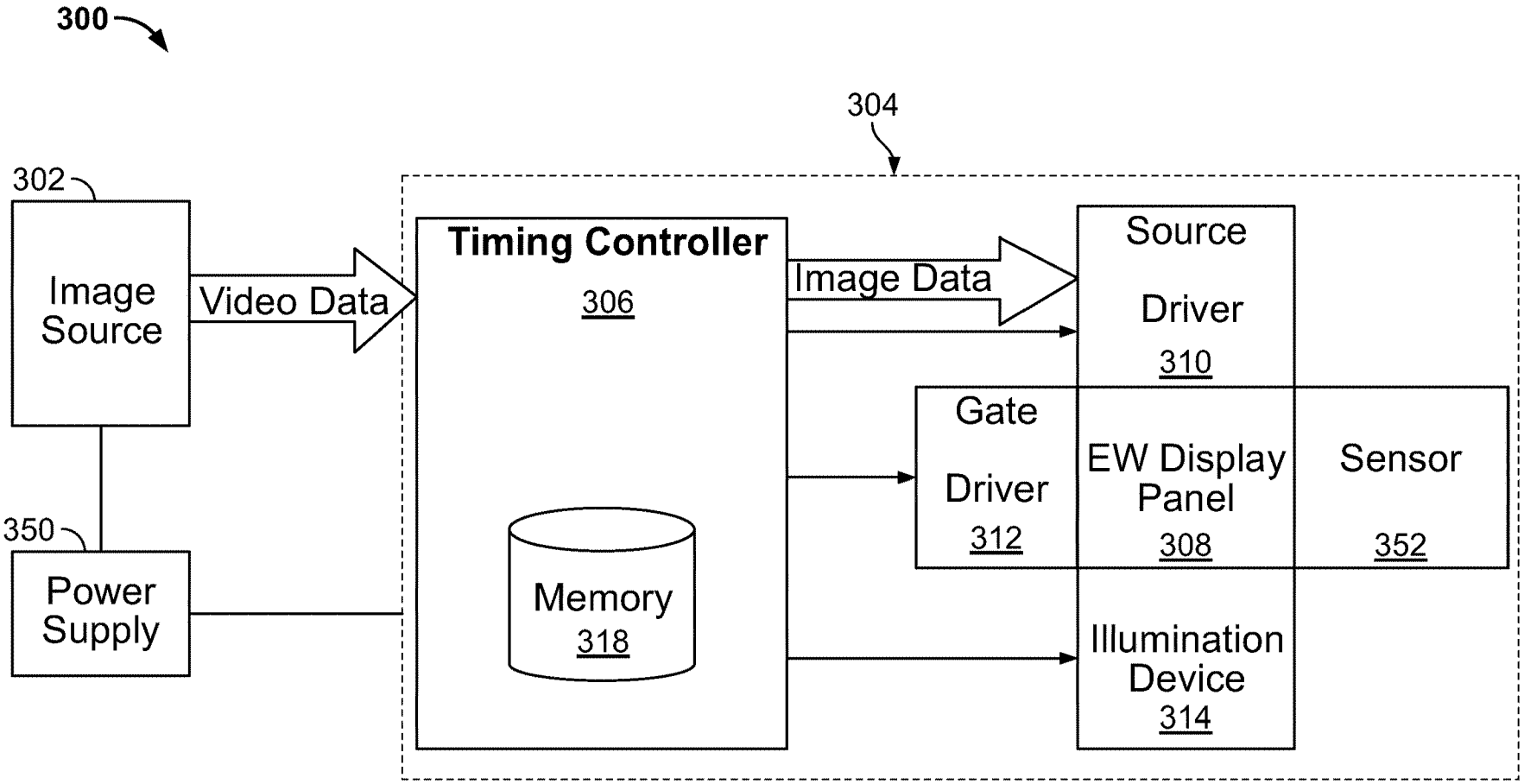
FIG. 2 schematically illustrates a simplified arrangement for a portion of an electronic device, according to some embodiments.

FIG. 2 schematically illustrates a simplified arrangement for a portion of an electronic display device 300 configured in accordance with the present disclosure to modify or update a drive scheme based upon a current operational mode of display device 300. Display device 300 comprises an image source 302, e.g., a graphic controller, and an electrowetting display 304 similar to the electrowetting display 100. The electrowetting display 304 comprises a timing controller 306, an electrowetting display panel 308 (similar to the electrowetting display panel 110 and thus, made up of rows and columns of pixel regions 112), source driver 310 and a gate driver 312. The timing controller 306 generally corresponds to the timing controller 102 of the electrowetting display 100 and the source driver 310 generally corresponds to the source driver 104 of the electrowetting display 100, while the gate driver 312 generally corresponds to the gate driver 106 of the electrowetting display 100. The timing controller 306 controls the source driver 310 and the gate driver 312 using one or more addressing schemes that are included in the timing controller 306 as either software or firmware in a memory, such as memory 318.

An illumination device 314 is coupled to display device 300 and configured to illuminate at least a portion of display panel 308 and the pixels therein. If display panel 308 is implemented as an array of transmissive pixels, the illumination device 314 may be implemented as a back light. In which case, when activated, the illumination device 314 causes light to pass through the open pixels of the display panel 308 to a viewer. Conversely, if the display panel 308 is implemented as an array of reflective pixels, the illumination device 314 may be implemented as a front light. In which case, when activated, the illumination device 314 causes light to strike the viewing surface of the display panel 308 and be reflected back out of open pixels to a viewer. The illumination device 314 may be implemented using any appropriate light generating devices, such as an LED or an array of LEDs.

Display device 300 includes power supply 350 configured to supply electrical energy to one or more of the components of display device 300. Power supply 350 may include, for example, a battery in combination with one or more power supply controller. Display device 300 may also include sensor 352 configured to measure an attribute of one or more components of display device 300. For example, sensor 352 may include a temperature sensor configured to detect a temperature of one or more device 300 components. In that case, sensor 352 may include any suitable temperature sensor, such as a thermocouple, thermistor, or resistance temperature detector. Sensor 352 could also include a voltage sensor, for example, configured to measure a voltage across one or more one or more components of device 300. For example, a voltage sensor may measure a voltage across one or more pixel capacitors within device 300 (e.g., the voltage across variable capacitance 156 depicted in FIG. 1C). As described below, such a voltage value may be used to optimize device 300 to minimize a backflow effect.

Memory 318 is configured to store a drive scheme for display device 300, though in various embodiments any suitable memory store may be utilized to store a drive scheme for display device 300. The drive scheme may be implemented as a configuration file setting forth a number of settings that determine how the various components of display device 300 operate. In general, the drive scheme may include settings for every component of display device 300, though in various embodiments, the drive scheme only sets forth a subset of potential settings for a subset of components of display device 300. In that case, to the extent a component of display device 300 requires a setting to operate that isn't defined in the drive scheme, that component may be pre-loaded with a fixed setting, rather than retrieve the setting from the drive scheme. In addition to a drive scheme, memory 318 may store additional configuration data, such as a mode of operation of a network communications device of display device 300 (e.g., what communication protocols are current enabled for the communications device, and the like). Memory 318 may also store settings that specify whether display device 300 is operating in a full color or black and white display mode, for example, and information describing how display device 300 is current being utilized (e.g., whether display device 300 is being used to display text content, display video, or play video games).

Table 1, below, illustrates a number of values that could be specified within a drive scheme for display device 300.

TABLE 1

| Value | Description |
|---|---|
| Tcon frequency 0.5-5 MHz | The operating frequency of the timing controller |
| Reset frequency 1-100 Hz | The frequency at which the pixel in the display device are to be refreshed |
| Vreset −5-(+5) V | The data voltage that should be used when resetting a pixel |
| Treset 0.5-5 ms | The time period over which a pixel is to be set to Vreset to be reset |
| Data signal voltage value −25 to −15 V | The voltage to be used when applying a data signal to a pixel in the display device |
| Gate signal voltage value −10 to −20 V | The voltage to be used on the gate line when applying a data signal to a pixel in the display device |
| Common voltage value −20 to 20 V | The common voltage value to be supplied by the voltage generator to components of the display device |
| Gate scanning algorithm | The algorithm that determines the sequence in which the timing controller addresses rows of pixels within the display device |

Depending upon the operational mode of display device 300, changes to the device's drive scheme may enable display device 300 to perform more efficiently, or provide an enhanced user experience. To facilitate the optimization of the drive scheme of display device 300, a cost function is defined that calculates or represents a performance attribute of display device 300 based upon a number of variables that correspond to or are otherwise associated with one or more values within the drive scheme. The performance attribute describes some characteristics or attribute of display device 300 based upon a current mode of operation of display device 300. For example, a cost function may be defined that calculates or represents a rate of power consumption of display device 300 based upon the common voltage values and gate scanning algorithm. The timing controller 306 is then configured to determine an optimized solution to the cost function. The optimized solution is one that results in a more desired behavior of display device 300. As such, in the present example the optimized solution may provide for a reduction in power consumption of display device 300. Other cost functions may be optimized to increase image quality or operating frequency or to maximize a luminance of display device 300.

The cost function is generally optimized by identifying optimum values of the variables that are inputs to the cost function. As such, where the cost function calculates or represents power consumption based a common voltage value and gate scanning algorithm, an optimum solution to the power consumption cost function may call for identifying values for the common voltage value variable and the gate scanning algorithm variable that ultimately minimize or reduce the output of the cost function, indicating that those values may result in reduced power consumption of the display device. Once those optimum values are determined, the timing controller can update the drive scheme with those values so that the components of display device 300 operate according to those values.

In the present system, cost functions can be determined for many different performance attributes of display device 300. Example cost functions may represent the power consumption of display device 300, the brightness of display panel 308, the frame rate of display panel 308, and the temperature of one or more components of display device 300, for example.

One example cost function could represent the amount of backflow observed within the pixels of display panel 308. In an electrowetting display, backflow is a tendency of the fluids within an electrowetting pixel, even when subjected to constant electrostatic forces, to return to their original resting condition. This tendency, therefore, causes the electrowetting pixel to gradually lose luminance over time as the first fluid returns to its resting position covering the entire pixel. Various variables can affect the backflow phenomenon within an electrowetting display device include the voltage and time duration specified for the display device's pixel reset process as well as the pixel's common voltage. Given that the backflow can be calculated based upon those variables, equation 1, below shows an example cost function for backflow within a particular electrowetting display device.

$$f_{backflow}(T_{reset}, V_{subreset}, V_{common}, V_{parasitic})=n\times[b\cdot T_{reset}\cdot(a\cdot V_{subreset}-V_{common}-V_{parasitic} \quad (1)$$

In equation 1, Treset refers to the duration over which a pixel is to be subjected to a reset signal. Vsubreset refers to the subreset voltage which is an increment to the defined reset voltage value for display device 300. Vcommon refers to the common voltage to be subjected to the display panel 308 while the reset pulse is applied. Vparasitic refers to the voltage across the variable pixel capacitance (e.g., capacitor 156 of FIG. 1C) formed between the transistor drain (e.g., drain 150 of TFT 114 of FIG. 1C) and common line (e.g., common line 152 of FIG. 1C). a, b, and n are numbers that are incorporated into the cost function. The values of a, b, and n are parameters that may be constants and could be determined based upon aspects of the design of display device 300 or electrical or physical phenomena. Alternatively, one or more of the values of a, b, and n could be determined based upon the current operational mode of display device 300. For example, the value a could be determined based upon the current current draw from a power supply of display device 300 or, for example, a current temperature of a component of display device 300. The current temperature of a component of display device 300 may be measured using temperature sensor 352, for example.

When implementing the cost function for backflow, the potential values for the variables Treset, Vsubreset, and Vcommon may be constrained by real-world limitations. For example, Treset may be constrained to values between 1 and 100, where the number refers to a number of addressing periods. Similar Vsubreset may be constrained to values between 0 and the reset voltage minus Vcommon, while Vcommon may be constrained to values greater than a gate signal voltage. Constraints could also be established for any parameters that are determined by the current operational mode of display device 300. For example, if a parameter refers to a current temperature of display device 300, that temperature parameter could be constrained to values between 0 and 75 Celsius.

In order to update the drive scheme, the timing controller 306 will attempt to calculate an optimized solution to the backflow cost function of equation 1. This involves identifying a set of values for the variables Treset, Vreset, and Vcommon that result in the smallest or optimum backflow result. In this example, the optimization of the backflow cost function is a tridimensional problem, with each dimension of the solution being Treset, Vsubreset and Vcommon, respectively, within the defined ranges. The timing controller may optimize the cost function in an iterative fashion. In each iteration an optimum solution representing an optimum driving scheme is proposed for minimizing the backflow cost function. The iteration steps may be repeated until the solutions proposed in each iteration converge on a solution, meaning that the optimum values of the variables of the backflow cost function have been identified. Once those values are established, the driving scheme can be updated using those values and the device can begin operating according to the optimized driving scheme.

For example, an optimum solution to the backflow cost function of equation 1 may be $(T_{reset}, V_{reset}, V_{common})=(1.5, -4, 15.75)$. With those values determined, the timing controller 306 could modify the drive scheme for display device 300 by setting the reset duration or pulse width to 1.5 milliseconds (ms), the subreset voltage to −4 V, and the common voltage to 15.75 V. The drive scheme may be updated, for example, by changes of one or more of the values contained within the drive scheme stored in memory 318. After the drive scheme has been updated, the device begins operating according to the updated drive scheme to minimize backflow within the device.

Another example cost function may represent power consumption of display device 300 according to the following expression: P (power)=DC (bias voltage)+A*C*$V^2$*F, where A is an activity factor, C is a capacitance, V is a voltage, and F is the display frequency.

In some cases, multiple cost functions can be combined. If, in a particular embodiment, it is desired to compensate for a loss of power due to the application of a reset pulse, for example, then it may be necessary to utilize a combined cost function of voltage. In that case, the combined cost function may take into account both the power consumption and the backflow effect. Depending on the user's requirements, the weights of these individual cost functions can be defined to provide an optimal driving scheme. For example, the back flow (BF) and power (P) cost functions could be combined as follows to determine a combined cost function (G): G=a*BF+b*P, where a and b are factors or other functions that define the weight of these two individual cost functions. The optimal drive scheme will take into account these two counteracting effects.

As mentioned above, many different cost functions may be used in accordance with the present disclosure. Various cost functions could be implemented that take as variables one or more elements from the display device 300's drive scheme and include parameters that are either fixed values or take values determined by the display device 300's current operating mode. In embodiments, the cost functions are stored in the memory 318 of the timing controller 306, though the cost functions could be stored in any memory accessible to timing controller 306 or another processor configured to retrieve and optimize the cost functions.

Figure 3A:
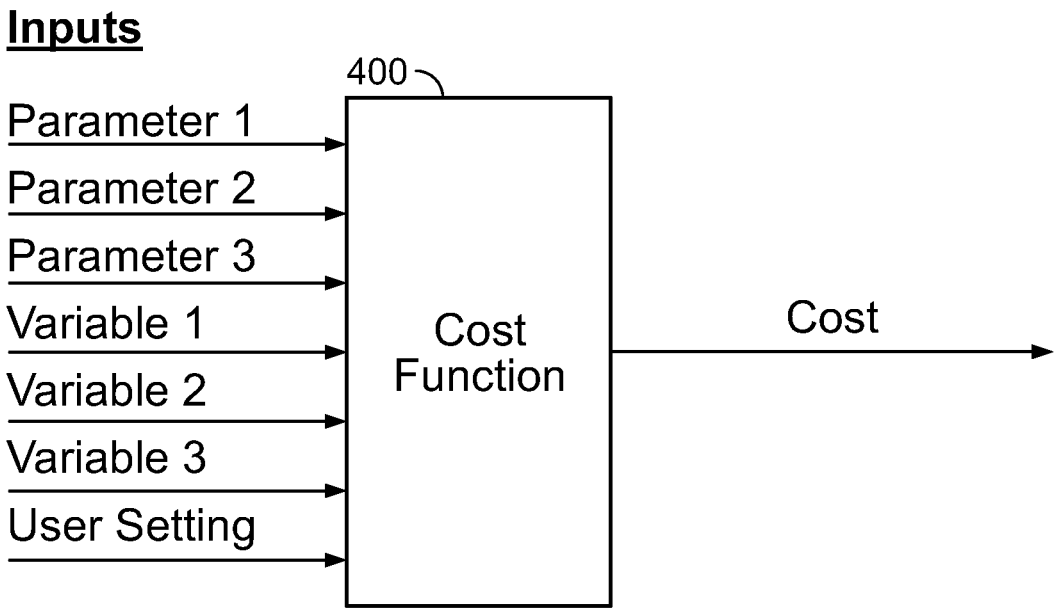
FIGS. 3A and 3B are illustrations showing example cost functions.

FIG. 3A is a block diagram illustrating an example cost function in accordance with the present disclosure. The cost function is configured to take a number of inputs and, based upon those inputs, calculate a performance attribute of display device 300. If the output of the cost function is associated with a cost (that is, some negative attribute of display device 300 that should be minimized), then an optimized set of inputs or variables would generate the lowest or a reduced output from the cost function. For example, if the cost function represents power consumption—a performance attribute that is generally desired to be minimized—an optimized set of inputs to the cost function would result in the smallest output of the cost function. In some embodiments, however, cost functions may be utilized in which the output of the cost function describes some performance attribute that is desired to be maximized. In that case an optimized set of inputs to the cost function could result in a maximum output of the cost function. An example of such a cost function may be a cost function describing screen resolution or refresh rate. In this disclosure, discussions relating to optimizing a cost function should be understood to apply appropriate to either minimizing or maximizing the output of the cost function.

Referring to FIG. 3A, cost function 400 takes as input a number of parameters. The parameters are generally model fitting parameters and may refer to constants that derive from the design or construction of electrowetting display device 300 or the current operational status of display device 300. Examples may include, for example, battery capacity, battery current draw, number of rows and columns of pixels, current temperature of one or more components of the device, operational frequencies of the timing controller or other processor or processors of the device, frame rate, for example, when watching a movie or playing a video game, light intensity, when activating or adjusting a front or back light, detected ambient light, and rates of heating of components of the device (e.g., to adjust the display performance to mitigate this effect), all of which may consume electrical energy from display device 300 including a display technology such as electrowetting display technologies or other similar display technologies.

Cost function 400 also takes as input a number of variables. These are the values that can be modified and/or adjusted in order to optimize the output of cost function 400. Generally, the variables of cost function 400 will each correspond to an item in the drive scheme of display device 300 and so, when the optimized variable values are determined, the drive scheme can be updated using those values in order to provide an optimized or improved drive scheme. In various embodiments, the potential values for the variable inputs are bounded by constraints that are normally related to hardware specifications. This prevents the optimized solution for a particular cost function calling for drive scheme values that cannot actually be implemented or used by display device 300.

FIG. 3A also shows that cost function 400 may take as an input one or more user settings. These are values that are determined by a specific user input to select a value for a particular user setting. For example, display device 300 may offer a user a number of different modes of operation, such as a low-power mode, high frame rate mode, and a reading mode. When in the lower power mode, the device should operate to use a minimal amount of power, while still providing adequate functionality. A lower power mode may involve, for example, reducing system voltages (e.g., lower source voltages or reset voltages), increasing reset times, reducing refresh rates, and reducing drive currents for the device's front or back light. In some embodiment, this may also involve, for example, reducing the device's frame rate below a threshold value, turning off unnecessary networking capabilities, and reducing backlight brightness, for example. The high frame rate mode, for example, may call for the device to provide a maximum image frame rate with no consideration of power consumption—this may be an operational mode well suited to displaying video content, for example. Finally, the reading mode may optimize the display device for the display of text data, such as by increasing the backlight brightness and increasing the display screen's contrast, while limiting the pixels of the display to either black and white. Other user settings that could be inputs to the cost function include the user-selected back or front light brightness (e.g., the drive current for the light emitting components of either the front or back light, whether network communication capabilities are enabled and, specifically, whether certain communication protocols (e.g., WiFi or 3rd generation (3G) communications) are enabled, and whether the device should operate in a color display mode or in a black and white display mode (e.g., for text depiction). In some cases, the user settings may be inferred from actions take by the user with respect to display device 300. For example, the user may start a video playing on display device 300. In that case, the display device 300 may automatically, and without specific input from the user, enter a high frame rate mode in which the operating frequency of components of display device 300 is increased in order to play the video. Alternatively, the user could begin reading static text content (or simply stop using display device 300), in which case display device 300 may enter a low-power mode suitable for displaying that text content.

In FIG. 3A only a single cost function associated with a single performance attribute of display device 300 is illustrated. In other embodiments, multiple cost functions could be established for a number of different device performance attributes. Those multiple cost functions could then be optimized together (e.g., as a single cost function) to develop a drive scheme that is optimized for a number of different performance attributes.

For example, in a device implementing multiple cost functions, the cost functions could be summed together and display device 300 may be configured to minimize the resulting sum of cost functions in order to determine an optimized drive scheme. In one specific embodiment, when summing several cost functions together, each cost function may be assigned a weight to control the degree to which each cost function affects the resulting summed cost function and, thereby, the optimized drive scheme. A cost function with a greater weight value may have a greater affect on the optimized result than a cost function with a lower weight.

To illustrate, a particular device may be configured to implement two cost functions—a cost function representing power consumption and a cost function representing pixel backflow. The cost functions could be summed together, as follows, to create a single cost function (Cost_Function) for the device: Cost_Function=A*Power_Consumption+B*Backflow.

In this example, the values A and B are weights that can be used to affect the degree to which each individual cost function affects the value of the summed cost function Cost_Function. The weights assigned to each cost function may be at least partially determined, in some embodiments, by user settings associated with the display device. For example, if the user should set the display device into a low power consumption mode, the weight 'A' assigned to the Power_Consumption cost function could be increased (e.g., doubled). As a result, the value of the Power_Consumption cost function will have a greater affect on the output of the cost function Cost_Function. As the weight assigned to the Power_Consumption cost function increases compared to the weight assigned to the Backflow cost function, the optimized solution to the cost function Cost_Function results in a drive scheme consuming less power.

Figure 3B:
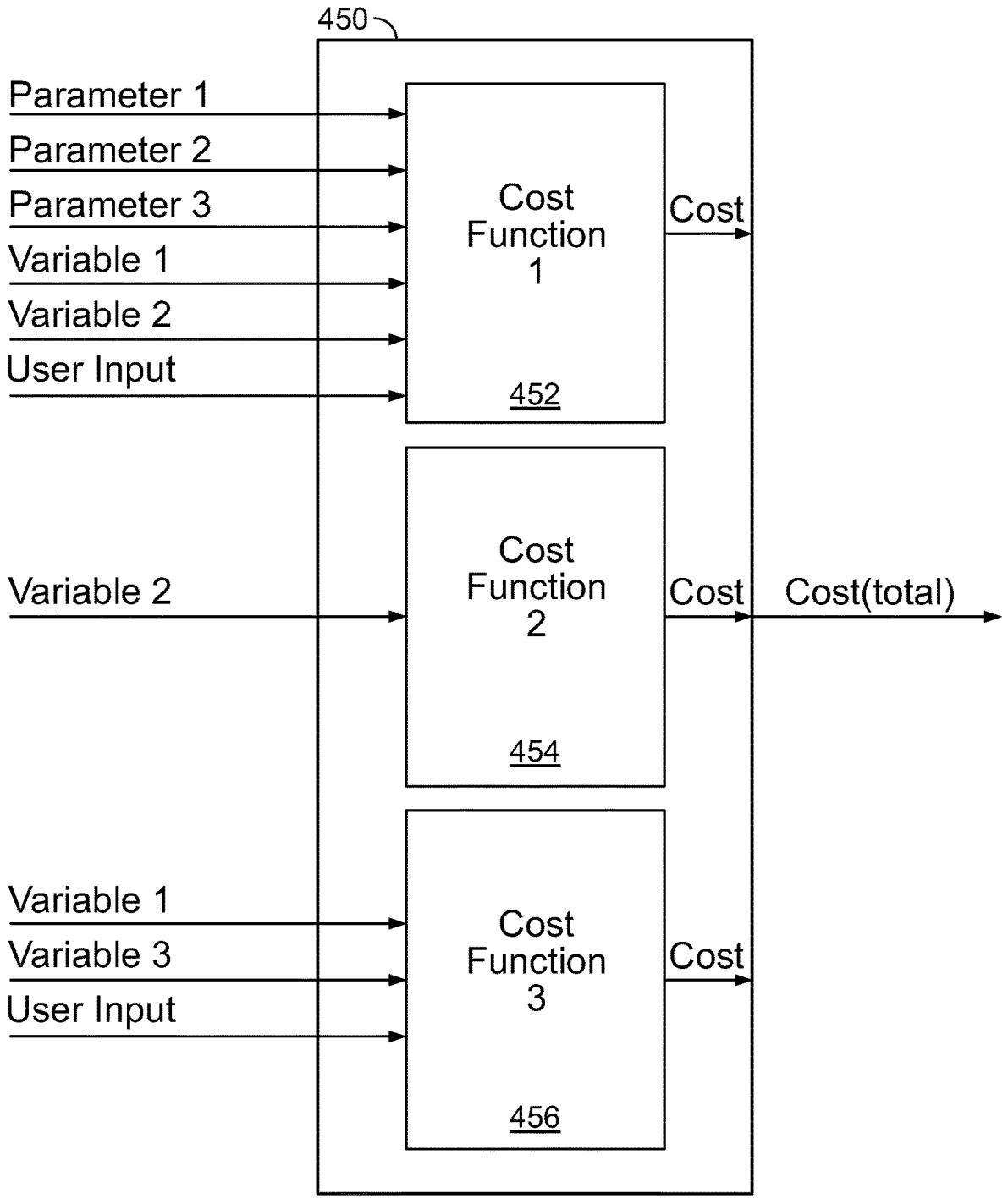

FIG. 3B shows a cost function 450 that includes a number of sub-cost functions 452, 454, 456. In this example, each of the sub-cost functions 452, 454, 456 may relate to a different performance parameter. For example, sub-cost function 452 may represent power consumption, sub-cost function 454 may represent backflow, and sub-cost function 456 may represent a back-light output level. Each sub-cost function 452 has a number of inputs that may include various combinations of parameters, variables, and user settings. Additionally, each sub-cost function 452, 454, 456 includes an output that, when the inputs to the sub-cost functions 452, 454, 456 are optimized will, in this example, have a minimum value.

For each sub-cost function 452, 454, 456 the variables (as in the case of the cost function illustrated in FIG. 3A) match values set forth in the drive scheme for display device 300. As such, each sub-cost function 452, 454, 456 represents a cost function that may be optimized in order to determine an optimum drive scheme for display device 300 to minimize that cost function. In this example, the three cost functions 452, 454, 456 have been combined into a single cost function 450 with a single output. Cost function 450 relates the three sub-cost functions 452, 454, 456 and includes the same set of inputs. As such, cost function 450 itself can be optimized to, in this example, identify optimized values for variables 1, 2, 3.

In display device 300, the timing controller 306 may be configured to self-learning or evolving algorithm to calculate an optimized solution to the device's one or more cost functions. With a set of objective cost functions defined (e.g., cost function 400 of FIG. 3A, cost functions 452, 454, and 456 of FIG. 3B or cost function 450 of FIG. 3B) and optional constraints on input variables, the cost functions can be optimized to ultimately determine optimized values for a drive scheme for display device 300. In one embodiment, timing controller 306 implements a PSO algorithm when optimizing the cost functions.

A PSO algorithm is configured to implement a biophysical model that may mimic the swarming behavior of different species (e.g., flocks of birds, schools of fish, swarms of insects, etc). When implementing the algorithm, a solution space is defined that covers all valid values of the input variables to a cost function. Then, a number of feasible, but not optimized, solutions within that solution space are created and represented by particles (independent agent) location within the solution space.

The algorithm can then call for moving each particle throughout a feasible search space (FSS) defined within the solution space in each iteration of the algorithm. With each movement the particles get closer to an optimum solution and begin to converge on that solution. Initially, when the particles are likely to be a long way away from the optimum solution, the particles may move a relatively large distance between iterations. But, as the particles converge on the optimum solution, the particles may move only a small distance between iterations. When the distance traveled by the particles between iterations falls below a particular threshold (referred to herein as a tolerance), the position of one of the particles (or an average position of a number of particles) may be designated to represent the optimized solution and the algorithm may terminate.

When implementing the PSO algorithm, the manner by which a solution may be moved or navigated through the feasible solution space is illustrated by equations 2 and 3, below.

$$v_{id}=\omega\cdot v_{id}+\eta_1\cdot rand_1(p_{id}-x_{id})+\eta_2\cdot rand_2(p_{gd}-x_{id}) \quad (2)$$

$$x_{id}=x_{id}+v_{id} \quad (3)$$

Within the feasible search space a particle travels at a velocity vid, for each particle i and over each dimension d, from its previous best position pi to a new position xi and the best location of all neighboring particles, pg (over each dimension d). The number of dimensions may be determined by the number of variables to optimize in the cost function and the movement of the solutions through the feasible search space, which is governed by equations (2) and (3) are constrained to feasible solutions of the given cost function. The algorithm defines two types of neighborhoods: local and global. The definition of a neighborhood may be useful for the iterative process to determine a solution. A local neighborhood may be a subset of the total number of particles, while in a global neighborhood all particles are each other's neighbors. The social and cognitive components are taken into account by $\eta 1$ and $\eta 2$, respectively, while $\omega$ is an inertia factor is used to balance the global and local search, respectively. The value $\omega$ may give rise to a memory effect useful to present the algorithm, when executed, drifting due to noise. The position of each particle for each iteration is given by Equation (3).

Figure 4:
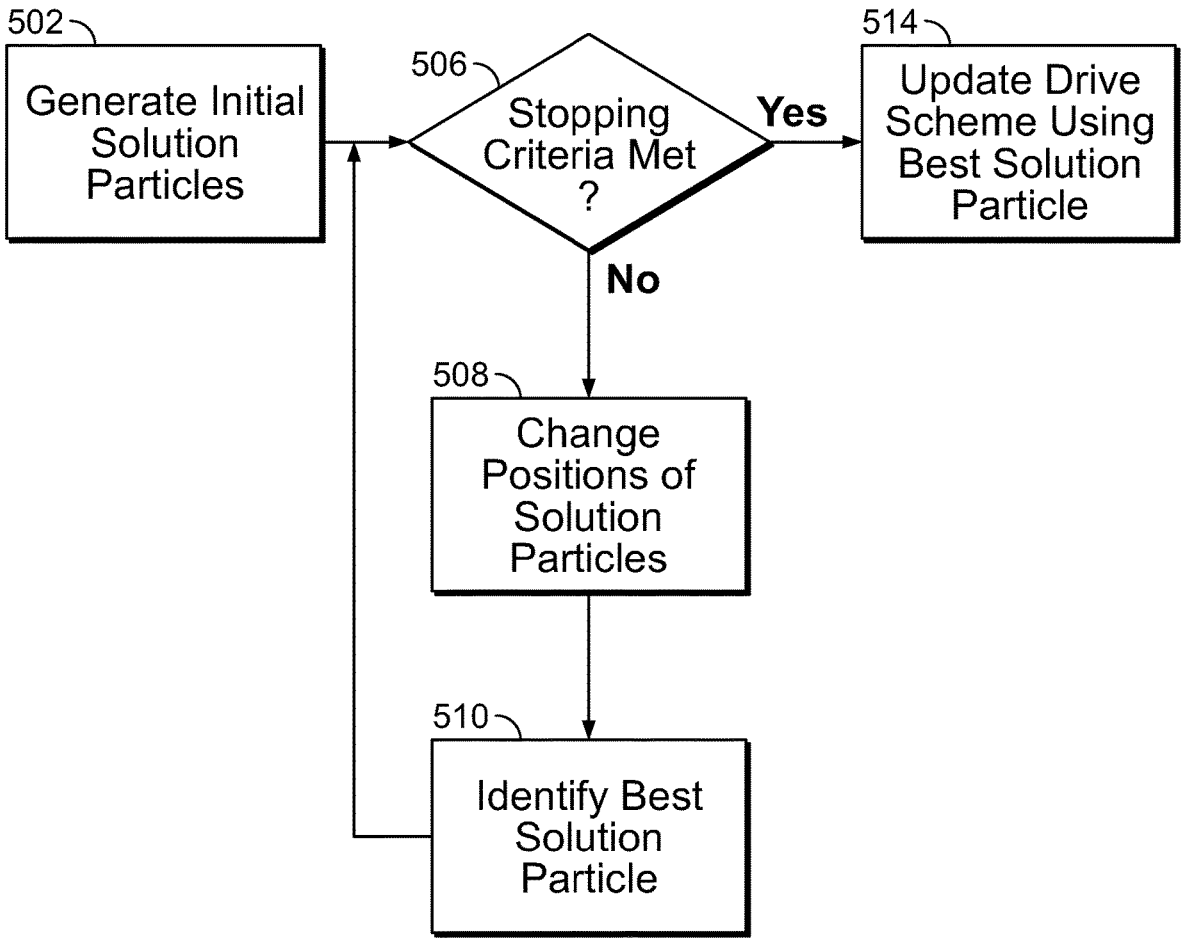
FIG. 4 is a flowchart illustrating a method for optimizing an output of a cost function.

Using the solution space set forth by equations 1 and 2, above, FIG. 4 is a flowchart illustrating a method for optimizing a cost function in accordance with the present disclosure. The method may be performed, for example, by the timing controller 306 of the display device 300 or any other processor in the display device 300 or in communication with the display device 300 (e.g., via a wireless communications network). The method may be executed continuously by the timing controller 306, or may be executed periodically at regular or semi-regular intervals (e.g., every 1, 5, or 10 seconds). In some embodiments, the timing controller 306 may execute the method so that a new optimized solution to the cost function is determined at least every 10 seconds.

The method of FIG. 4 can be executed to determine a set of optimized variable values, where the variables are inputs to a cost function. As described above, cost functions may take additional inputs, such as parameters or user inputs. At or about the time method 500 is executed, however, the values of those parameters or user settings are determined and fixed within the cost function. For example, if a cost function takes an input parameters of display device 300 temperature, at or about the time method 500 is executed, timing controller 306 will access a temperature sensor within display device 300 to determine a temperature value associated with display device 300. That value will then become a fixed input to the cost function.

In step 502 an initial set of basic feasible or admissible solutions (sometimes referred to as solution particles) are generated. Each feasible solution in the set of solutions represents a valid solution to the cost function. Each solution represents a particular point in the solution space for the cost function and so each solution will be a point in that solution space having a number of dimensions that is equal to the number of variables in the cost function. As part of step 502, the timing controller 306 may determine the values of one or more parameters or user settings that are inputs to the cost function. The initial set of solutions may be generated in a random or pseudo-random manner to ensure that the set of solutions is distributed throughout the solution space.

In step 506, an evaluation is made to determine whether a stopping criteria for the algorithm has been met. This may involve, for example, determining whether a solution provided by the best of the solutions satisfies a given tolerance requirement. In one embodiment, a tolerance factor E may be defined as requiring that the difference between the current best solution and the immediately prior best solution differ by a sufficiently small amount. If the difference between the current best solution and the immediately prior best solution is greater than the tolerance factor E, the tolerance condition of step 506 has not been met and the algorithm will enter the refinement loop set forth by steps 508 and 510. If, however, the difference between the current best solution and the immediately prior best solution is less than the tolerance factor E that indicates that the algorithm has converged on an optimum solution and the stopping criteria has been met.

In other embodiments, the stopping criteria may involve comparing the number of times the refinement loop of steps 508 and 510 have been executed to a threshold. After the refinement loop has run that maximum number of times, the algorithm will move to step 514 even if the best solution does not satisfy the tolerance factor described above.

If the stopping criteria of step 506 has not been met, the algorithm moves to step 508 in which the positions of the various solutions within the solution space are changed. This may involve, for example, identifying a best solution within a neighborhood of solutions and then modifying the position of each solution within that neighborhood in a manner at least particular determined by the best solution within the neighborhood. This approach may be implemented for a large number of neighborhoods that may exist within a particular solution space.

With the solution positions updated in step 508, in step 510 the best solution is identified. This may involve identifying one of the solutions that minimizes the output of the cost function for a cost function expressing a performance attribute that is desired to be minimized (e.g., power consumption). Conversely, for a cost function expressing a performance attribute that is desired to be maximized (e.g., timing controller operating frequency), this may involve comparing the solutions to identify one that maximizes the output of the cost function.

If, however, in step 506 the tolerance has been met, indicating that the current position of the best solution represents an optimized solution to the cost function, in step 514 the drive scheme for display device 300 is updated based upon the solution identified by the best solution. As described above, the best solution defines an optimized value for each of the variable inputs to the cost function. Each of those variable inputs corresponds to a value contained within the drive scheme for display device 300 enabling the drive scheme to be updated based upon the best solution. After the drive scheme is updated, the various components of display device 300 can utilize the updated drive scheme to control their operation within display device 300.

In other embodiments, any suitable optimization algorithms may be utilized to optimize the one or more cost functions of display device 300. For example, genetic or differential evolution approaches may be used to perform the optimization. In general, any algorithm suitably configured to determine an optimized (or quasi-optimized) solution to the one or more cost functions may be utilized in accordance with the present disclosure to modify or update a drive scheme for a display device.

Figure 5:
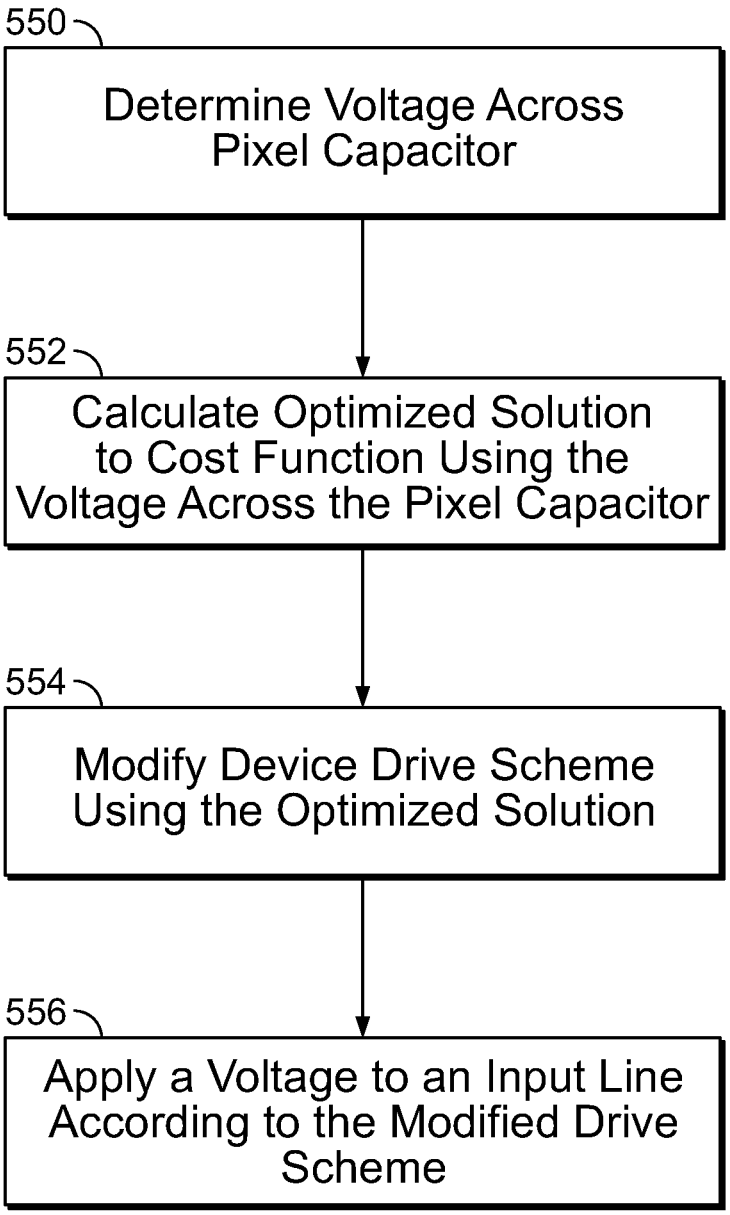
FIG. 5 is a flowchart illustrating a specific method for optimizing a drive scheme of an electrowetting display device.

In one specific embodiment, an optimization algorithm is utilized to optimize a cost function in order to minimize a backflow effect occurring within an electrowetting display pixel of an electrowetting display device. FIG. 5 is a flowchart illustrating that specific method. In step 550, a processor within the electrowetting display device (e.g., a timing controller) determines a voltage across a capacitor of at least one of the electrowetting display pixels of the electrowetting display device. For example, the processor may determine a voltage across the variable capacitance 156 depicted in FIG. 1C of a particular electrowetting display pixel. In step 552, the processor calculates an optimized solution to a backflow cost function using the voltage value determined in step 550. This may involve, for example, determining an optimized solution to equation (1), above. After the optimized solution is calculated, in step 554 a drive scheme for the electrowetting display device is updated using the values determined by the optimized solution. Finally, in step 556, voltages are applied to input lines of the electrowetting display pixel in accordance with the modified drive scheme. The voltages being applied are optimized to minimize the backflow effect within the electrowetting display pixel.

The addressing scheme of the timing controller 306 is generally provided via software or firmware to perform one of the methods of providing luminance compensation. However, in embodiments, the addressing scheme of the timing controller 306 may be provided via software or firmware to perform one or more of the methods. In such embodiments, a user of the electronic display device 300 (and thus a user of the electrowetting display 304) may select which method to use or the timing controller 306 may select which method to use based upon pre-determined criteria such as power consumption, reduced visual artifacts, etc.

Figure 6:
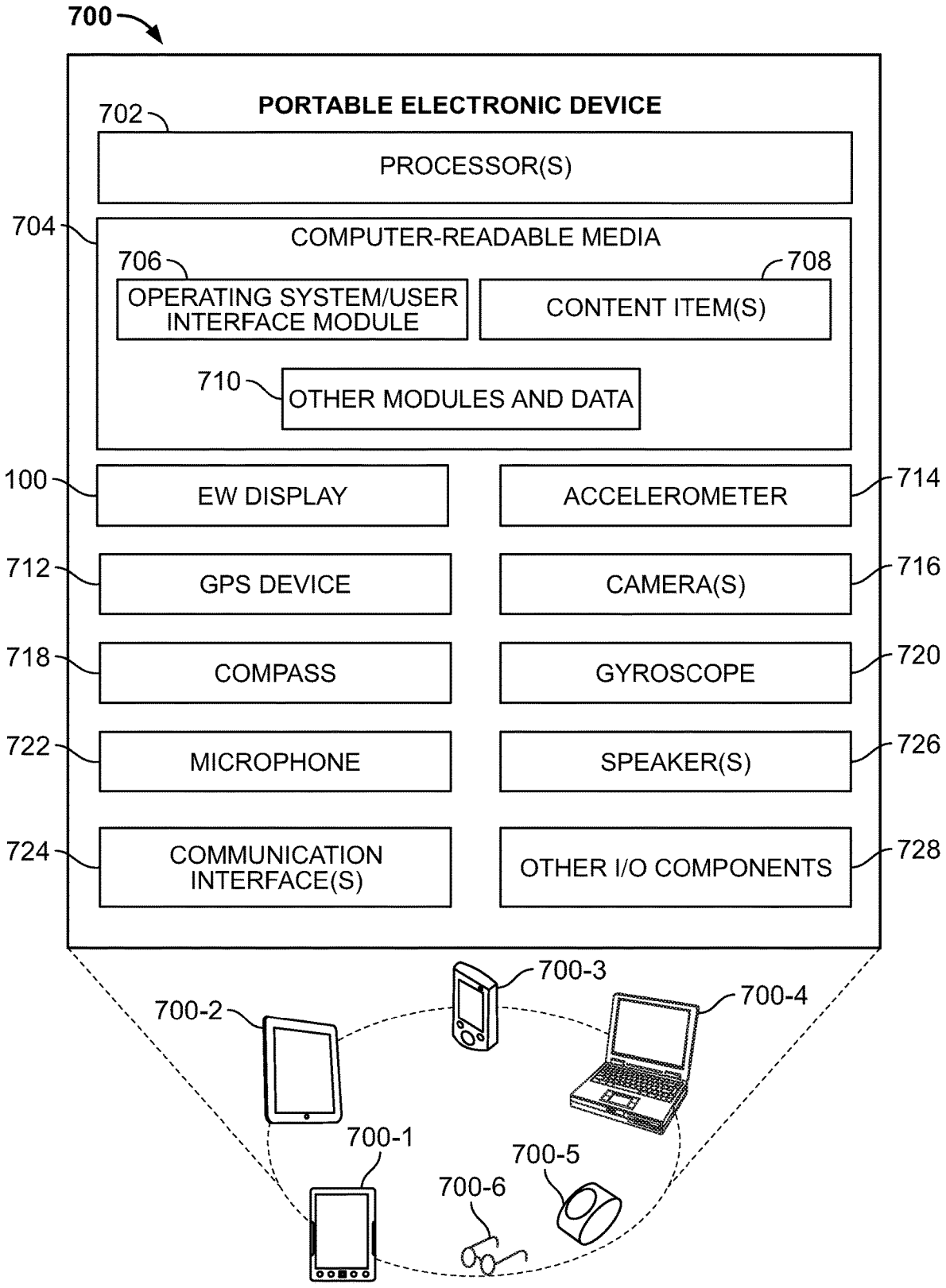
FIG. 6 illustrates select components of an example image display apparatus that may include an electrowetting display, according to various embodiments.

FIG. 6 illustrates select example components of an example image display apparatus 700 that may be used with the electrowetting display device 100 according to some implementations. Other types of displays may also be used with the example image display apparatus 700. Such types of displays include, but are not limited to, LCDs, cholesteric displays, electrophoretic displays, electrofluidic pixel displays, photonic ink displays, and the like.

The image display apparatus 700 may be implemented as any of a number of different types of electronic devices. Some examples of the image display apparatus 700 may include digital media devices and eBook readers 700-1; tablet computing devices 700-2; smart phones, mobile devices and portable gaming systems 700-3; laptop and netbook computing devices 700-4; wearable computing devices 700-5; augmented reality devices, helmets, goggles or glasses 700-6; and any other device capable of connecting with the electrowetting display device 100 and including a processor and memory for controlling the display according to the techniques described herein.

In a very basic configuration, the image display apparatus 700 includes, or accesses, components such as at least one control logic circuit, central processing unit, or processor 702, and one or more computer-readable media 704. Each processor 702 may itself comprise one or more processors or processing cores. For example, the processor 702 can be implemented as one or more microprocessors, microcomputers, microcontrollers, digital signal processors, central processing units, state machines, logic circuitries, and/or any devices that manipulate signals based on operational instructions. In some cases, the processor 702 may be one or more hardware processors and/or logic circuits of any suitable type specifically programmed or configured to execute the algorithms and processes described herein. The processor 702 can be configured to fetch and execute computer-readable instructions stored in the computer-readable media 704 or other computer-readable media. The processor 702 can perform one or more of the functions attributed to the timing controller 102, the source driver 104, and/or the gate driver 106 of the electrowetting display device 100. The processor 702 can also perform one or more functions attributed to a graphic controller (not illustrated) for the electrowetting display device.

Depending on the configuration of the image display apparatus 700, the computer-readable media 704 may be an example of tangible non-transitory computer storage media and may include volatile and nonvolatile memory and/or removable and non-removable media implemented in any type of technology for storage of information such as computer-readable instructions, data structures, program modules or other data. The computer-readable media 704 may include, but is not limited to, RAM, ROM, EEPROM, flash memory or other computer readable media technology, CD-ROM, digital versatile disks (DVD) or other optical storage, magnetic cassettes, magnetic tape, solid-state storage and/or magnetic disk storage. Further, in some cases, the image display apparatus 700 may access external storage, such as RAID storage systems, storage arrays, network attached storage, storage area networks, cloud storage, or any other medium that can be used to store information and that can be accessed by the processor 702 directly or through another computing device or network. Accordingly, the computer-readable media 704 may be computer storage media able to store instructions, modules or components that may be executed by the processor 702.

The computer-readable media 704 may be used to store and maintain any number of functional components that are executable by the processor 702. In some implementations, these functional components comprise instructions or programs that are executable by the processor 702 and that, when executed, implement operational logic for performing the actions attributed above to the image display apparatus 700. Functional components of the image display apparatus 700 stored in the computer-readable media 704 may include the operating system and user interface module 706 for controlling and managing various functions of the image display apparatus 700, and for generating one or more user interfaces on the electrowetting display device 100 of the image display apparatus 700.

In addition, the computer-readable media 704 may also store data, data structures and the like, that are used by the functional components. For example, data stored by the computer-readable media 704 may include user information and, optionally, one or more content items 708. Depending on the type of the image display apparatus 700, the computer-readable media 704 may also optionally include other functional components and data, such as other modules and data 710, which may include programs, drivers and so forth, and the data used by the functional components. Further, the image display apparatus 700 may include many other logical, programmatic and physical components, of which those described are merely examples that are related to the discussion herein. Further, while the figures illustrate the functional components and data of the image display apparatus 700 as being present on the image display apparatus 700 and executed by the processor 702 on the image display apparatus 700, it is to be appreciated that these components and/or data may be distributed across different computing devices and locations in any manner.

FIG. 6 further illustrates examples of other components that may be included in the image display apparatus 700. Such examples include various types of sensors, which may include a GPS device 712, an accelerometer 714, one or more cameras 716, a compass 718, a gyroscope 720, a microphone 722, and so forth.

The image display apparatus 700 may further include one or more communication interfaces 724, which may support both wired and wireless connection to various networks, such as cellular networks, radio, Wi-Fi networks, close-range wireless connections, near-field connections, infrared signals, local area networks, wide area networks, the Internet, and so forth. The communication interfaces 724 may further allow a user to access storage on or through another device, such as a remote computing device, a network attached storage device, cloud storage, or the like.

The image display apparatus 700 may further be equipped with one or more speakers 726 and various other input/output (I/O) components 728. Such I/O components 728 may include a touchscreen and various user controls (e.g., buttons, a joystick, a keyboard, a keypad, etc.), a haptic or tactile output device, connection ports, physical condition sensors, and so forth. For example, the operating system 706 of the image display apparatus 700 may include suitable drivers configured to accept input from a keypad, keyboard, or other user controls and devices included as the I/O components 728. Additionally, the image display apparatus 700 may include various other components that are not shown, examples of which include removable storage, a power source, such as a battery and power control unit, a PC Card component, and so forth.

In an embodiment, an electrowetting display device includes a first substrate and a second substrate opposite to the first substrate, and a pixel region between the first substrate and the second substrate. The pixel region includes a data line and a gate line for controlling a state of a pixel in the pixel region. The electrowetting display device includes an oil and an electrolyte solution that is immiscible with the oil. The oil and the electrolyte solution are disposed between the first substrate and the second substrate. The electrowetting display device includes a memory storing a cost function. The cost function represents a power consumption of the electrowetting display device. The cost function has a plurality of variables including a data signal voltage variable and a gate signal voltage variable. The electrowetting display device includes a timing controller configured to calculate an optimized solution to the cost function. The optimized solution includes a data signal voltage value and a gate signal voltage value. The timing controller is configured to store the data signal voltage value and the gate signal voltage value in the memory, cause a source driver to apply a drain voltage to a data line connected to the pixel in accordance with the data signal voltage value, and cause a gate driver to apply a gate voltage to a gate line connected to the pixel in accordance with the gate signal voltage value.

In another embodiment, a display device includes a first substrate and a second substrate opposite to the first substrate, and a pixel region on the first substrate. The pixel region includes a plurality of input lines. Each input line is configured to apply an electric potential to a portion of a pixel in the pixel region. The display device includes a memory storing a drive scheme for the display device; and a pixel control system configured. The pixel control system is configured to calculate a solution to a cost function for the display device, the cost function expressing a performance attribute of the display device, modify the drive scheme using the solution to the cost function to create a modified drive scheme, and apply a voltage to one of the plurality of input lines according to the modified drive scheme to drive the display device.

In another embodiment, a method includes determining a voltage across a drain terminal of a transistor in a pixel region of the display device and a common line in the pixel region of the display device, and calculating a solution to a cost function for the display device using the voltage across the drain terminal and the common line. The cost function expresses a performance attribute of the display device and the solution includes at least one of a data signal voltage value, a gate signal voltage value, and a common voltage value. The method includes modifying a drive scheme of the display device using the solution to the cost function to create a modified drive scheme, and applying a voltage to one of a plurality of input lines in the pixel region of the display device according to the modified drive scheme.

Various instructions, methods and techniques described herein may be considered in the general context of computer-executable instructions, such as program modules stored on computer storage media and executed by the processors herein. Generally, program modules include routines, programs, objects, components, data structures, etc., for performing particular tasks or implementing particular abstract data types. These program modules, and the like, may be executed as native code or may be downloaded and executed, such as in a virtual machine or other just-in-time compilation execution environment. Typically, the functionality of the program modules may be combined or distributed as desired in various implementations. An implementation of these modules and techniques may be stored on computer storage media or transmitted across some form of communication.

Although the subject matter has been described in language specific to structural features and/or methodological acts, it is to be understood that the subject matter defined in the appended claims is not necessarily limited to the specific features or acts described. Rather, the specific features and acts are disclosed as illustrative forms of implementing the claims.

One skilled in the art will realize that a virtually unlimited number of variations to the above descriptions are possible, and that the examples and the accompanying figures are merely to illustrate one or more examples of implementations.

It will be understood by those skilled in the art that various other modifications can be made, and equivalents can be substituted, without departing from claimed subject matter. Additionally, many modifications can be made to adapt a particular situation to the teachings of claimed subject matter without departing from the central concept described herein. Therefore, it is intended that claimed subject matter not be limited to the particular embodiments disclosed, but that such claimed subject matter can also include all embodiments falling within the scope of the appended claims, and equivalents thereof.

In the detailed description above, numerous specific details are set forth to provide a thorough understanding of claimed subject matter. However, it will be understood by those skilled in the art that claimed subject matter can be practiced without these specific details. In other instances, methods, devices, or systems that would be known by one of ordinary skill have not been described in detail so as not to obscure claimed subject matter.

Reference throughout this specification to "one embodiment" or "an embodiment" can mean that a particular feature, structure, or characteristic described in connection with a particular embodiment can be included in at least one embodiment of claimed subject matter. Thus, appearances of the phrase "in one embodiment" or "an embodiment" in various places throughout this specification are not necessarily intended to refer to the same embodiment or to any one particular embodiment described. Furthermore, it is to be understood that particular features, structures, or characteristics described can be combined in various ways in one or more embodiments. In general, of course, these and other issues can vary with the particular context of usage. Therefore, the particular context of the description or the usage of these terms can provide helpful guidance regarding inferences to be drawn for that context.

What is claimed is:

1. A display device, comprising:

a first substrate and a second substrate opposite to the first substrate;

a pixel region on the first substrate, the pixel region including a plurality of input lines, each input line configured to apply an electric potential to a portion of a pixel in the pixel region;

a memory storing a drive scheme for the display device; and a pixel control system configured to:

determine a value of a parasitic voltage across a drain terminal of a transistor of the pixel region and a common line of the pixel region, calculate, using the value of the parasitic voltage, a solution to a cost function for the display device, the cost function representing an amount of backflow in the display device, modify the drive scheme using the solution to the cost function to create a modified drive scheme, and apply an electric potential to one of the plurality of input lines according to the modified drive scheme to drive the display device.

2. The display device of claim 1, wherein:

the pixel control system includes a timing controller configured to control a source driver and a gate driver to control a state of the pixel of the display device;

the solution to the cost function includes a value associated with a target operating frequency for the timing controller; and the pixel control system is configured to set an operating frequency of the timing controller using the value associated with the target operating frequency in the solution to the cost function.

3. The display device of claim 1, wherein:

the pixel control system includes a timing controller configured to control a source driver and a gate driver to control a state of the pixel of the display device;

the solution to the cost function includes a first value associated with a reset voltage value; and the timing controller is configured to cause the source driver to apply the electric potential to the one of the plurality of input lines in accordance with the reset voltage value to reset the pixel.

4. The display device of claim 3, wherein:

the solution to the cost function includes a second value associated with a reset duration; and the timing controller is configured to cause the source driver to apply the electric potential to the one of the plurality of input lines in accordance with the reset voltage value to reset the pixel for a time period determined by the reset duration.

5. The display device of claim 1, wherein:

the pixel control system includes a timing controller configured to control a gate driver;

the plurality of input lines includes a gate line;

the solution to the cost function includes a gate signal voltage value; and the timing controller is configured to cause the gate driver to apply the electric potential to the gate line in accordance with the gate signal voltage value.

6. The display device of claim 1, wherein the pixel control system is configured to calculate the solution to the cost function by:

calculating a first solution to the cost function, the first solution including a first value for a first variable of the cost function;

calculating a second solution to the cost function, the second solution including a second value for the first variable of the cost function; and comparing an output of the cost function using the first solution to a second output of the cost function using the second solution.

7. The display device of claim 1, wherein the cost function includes a variable associated with a current draw of a component of the display device from a power source and the pixel control system is configured to determine the current draw of the component before calculating the solution to the cost function.

8. The display device of claim 1, wherein the cost function includes a variable associated with a current mode of operation of the display device and the current mode of operation of the display device is selected by a user of the display device.

9. The display device of claim 1, wherein the cost function represents a rate of power consumption from a power source of the display device and the solution to the cost function minimizes an output value of the cost function.

10. The display device of claim 1, wherein, to calculate the solution to the cost function, the pixel control system is configured to identify a respective value for each variable that is an input to the cost function.

11. The display device of claim 1, wherein the cost function represents at least one of: (i) power consumption of the display device, (ii) brightness of the display device, (iii) frame rate of the display device, or (iv) temperature of one or more components of the display device.

12. A method of driving a display device, comprising:

determining a value of a parasitic voltage across a drain terminal of a transistor of a pixel region of the display device and a common line of the pixel region of the display device;

calculating a solution to a cost function for the display device using the value of the parasitic voltage, the cost function representing an amount of backflow in the display device, the solution including at least one of a data signal voltage value, a gate signal voltage value, and a common voltage value;

modifying a drive scheme of the display device using the solution to the cost function to create a modified drive scheme; and applying an electric potential to one of a plurality of input lines in the pixel region of the display device according to the modified drive scheme.

13. The method of claim 12, wherein the solution to the cost function includes a target operating frequency for a timing controller of the display device and further comprising setting an operating frequency of the timing controller to the target operating frequency.

14. The method of claim 12, wherein the solution to the cost function identifies a reset voltage value and further comprising causing a source driver of the display device to apply the electric potential to the one of the plurality of input lines in accordance with the reset voltage value to reset a pixel in the pixel region.

15. The method of claim 14, wherein the solution to the cost function identifies a reset duration and further comprising causing the source driver to apply the electric potential to the one of the plurality of input lines in accordance with the reset voltage value to reset the pixel for a time period determined by the reset duration.

16. The method of claim 12, wherein calculating the solution to the cost function includes:

calculating a first solution to the cost function, the first solution including a first value for a first variable of the cost function;

calculating a second solution to the cost function, the second solution including a second value for the first variable of the cost function; and comparing an output of the cost function using the first solution to a second output of the cost function using the second solution.

17. The method of claim 12, wherein the cost function includes a variable associated with a current draw of a component of the display device from a power source and further comprising determining the current draw of the component before calculating the solution to the cost function.

18. The method of claim 12, wherein the cost function includes a variable associated with a current mode of operation of the display device and further comprising determining the current mode of operation of the display device by determining a value of a user setting.

19. The method of claim 12, wherein the cost function represents at least one of: (i) power consumption of the display device, (ii) brightness of the display device, (iii) frame rate of the display device, or (iv) temperature of one or more components of the display device.

* * * * *